United States Patent [19]

Hennes et al.

[11] 3,940,968

[45] Mar. 2, 1976

[54] DEVICE FOR MAKING HOLLOW BODIES

[75] Inventors: Heinrich Hennes; Walter Sommer, both of Essen, Germany

[73] Assignee: Fried. Krupp Gesellschaft mit beschrankter Haftung, Essen, Germany

[22] Filed: June 3, 1974

[21] Appl. No.: 475,807

[30] Foreign Application Priority Data

June 8, 1973 Germany ..... 2329241

[52] U.S. Cl. ..... 72/349

[51] Int. Cl.[2] ..... B21D 22/20

[58] Field of Search ..... 72/347, 348, 349

[56] References Cited

UNITED STATES PATENTS 961,133 6/1910 Higgins ..... 72/349

3,771,345 11/1973 Paramonoff ..... 72/349

FOREIGN PATENTS OR APPLICATIONS 1,270 1/1893 United Kingdom ..... 72/349

*Primary Examiner*—Milton S. Mehr

*Attorney, Agent, or Firm*—Walter Becker

[57] ABSTRACT

A device for making hollow bodies open at one end, by punching, drawing and/or ironing, in which the annular shaping tools which form the hollow body are arranged on a holding plate which is pivotable about an axis transverse to the axis of movement of the drawing mandrel and in spaced relationship to the latter.

2 Claims, 2 Drawing Figures

DEVICE FOR MAKING HOLLOW BODIES

The present invention relates to a device for making hollow bodies which are open at one side and which device is equipped with a cutting tool for cutting out blanks from a sheet metal strip and/or is equipped with a broach or drawing mandrel, drawing die or at least one drawing ring for deep drawing or ironing of hollow bodies from blanks or cups. Containers which are open at one side and have been made by deep drawing as for instance the hull of cans, fire extinguishing containers or hydraulic cylinders are characterized by a high volume precision and good surface quality, have very favorable factors of taking full advantage of the material with regard to its strength while no seams are provided. In particular, when making cans for beverages, the low sheet metal consumption and the possibility of providing the can around its circumference with writing or printing is of importance.

Devices of the above mentioned kind for making containers of the above mentioned type are known and more specifically devices for making large containers such as fire extinguishers as well as devices for the manufacturing of cans. Heretofore known devices of the general type set forth above generally operate satisfactorily. However, operational disorders may occur when materials are employed which have local faults. The sheet metal strip can, for instance, not always cut very clean. It may also be pierced by the drawing mandrel or broach when the sheet metal band forms a plane cut, or the drawn part may tear. Furthermore, when the container is trimmed in the same device with regard to its length, waste strips may remain in the tool. In such instances, it is frequently difficult and time consuming to remove the metal from the tool arrangement in order to overcome the disorder.

It is therefore, an object of the present invention to improve the accessibility to the tool arrangement in order more easily to remove waste material which in view of disorders remained in the tool. It is another object of this invention to provide a device as set forth in the preceding paragraph which will permit an axial exchange of tool elements for instance for post grinding purposes.

These and other objects and advantages of the invention will appear more clearly from the following specification in connection with the accompanying drawings, in which.

Figure 1:
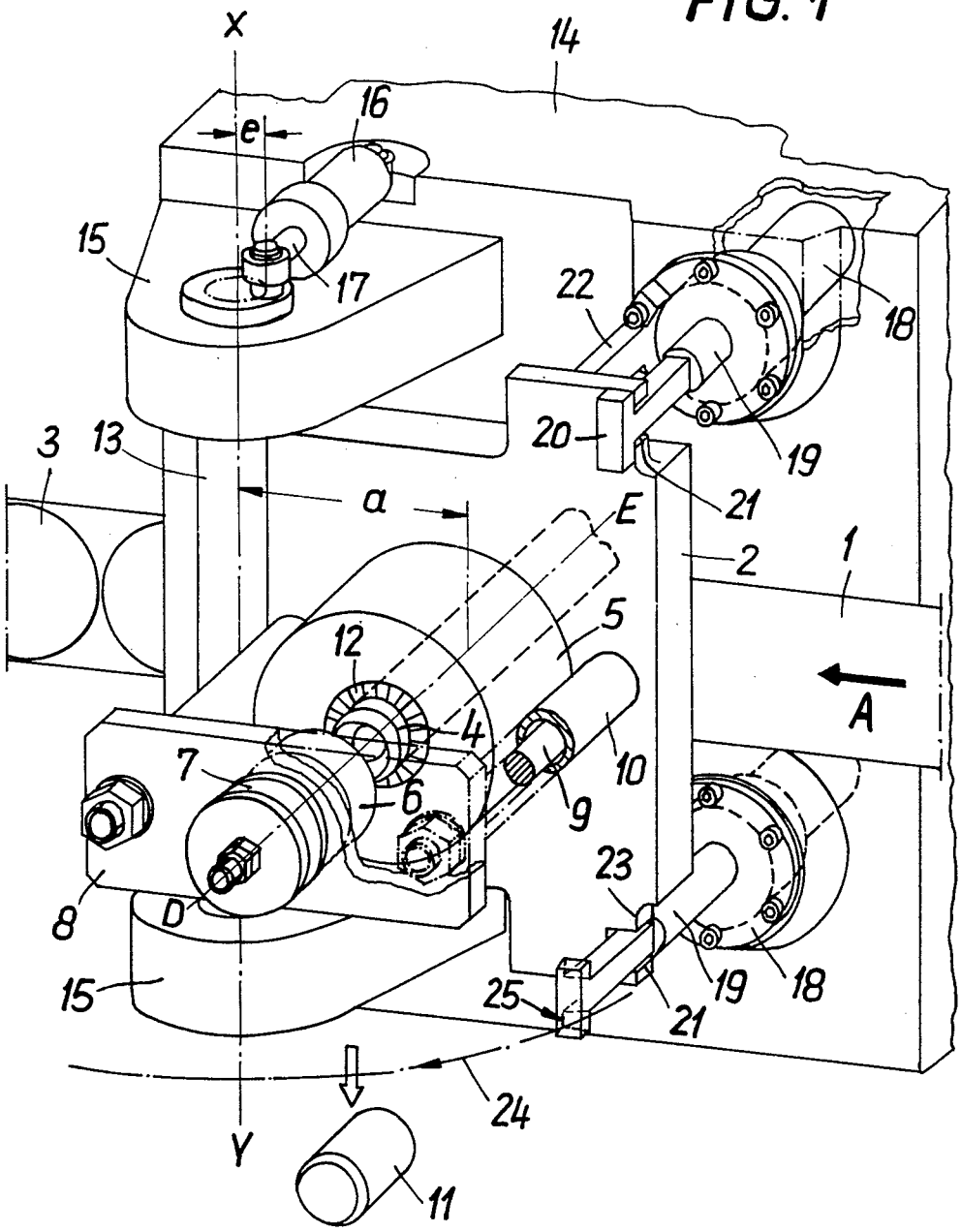
FIG. 1 is an isometric view of a portion of the device according to the present invention.

The problem underlying the present invention has been solved by the fact that the annular tool parts (matrices) are combined to a structural unit which is pivotable about an axis extending transverse to the axis of movement of the broach or drawing mandrel, and extends in spaced relationship to said axis of movement of said broach or drawing mandrel.

In order to be able easily to handle this structural unit even if it should have greater dimensions, it is suggested to pivot the same by means of an auxiliary drive. At any rate, however, it must be possible to lock this structural unit relative to the frame when the structural unit is in its condition of operation. It is necessary that the drive for the device can be started only after the structural unit has been locked in position.

Referring now to the drawing in detail, a sheet metal strip 1 is in the direction indicated by the arrow A moved stepwise by the device and is thus conveyed to a non-illustrated cutting tool located behind the plate 2. The cutting tool is adapted to punch circular plane cuts out of said strip 1. The thus occurring holes in the strip are designated with the reference numeral 3. For purposes of making better use of the strip, it is possible to punch out the workpiece from the strip in a plurality of rows. To this end the strip is moved either in a zigzag shaped manner through the tool, or the device comprises a plurality of tool sets which are arranged in an offset manner with regard to each other. This, however, does not form a part of the present invention. A reciprocatory drawing mandrel 4 which extends along the horizontal tool axis D–E will then grasp the cut and during its movement through a drawing ring and at least one stretching ring all arranged in a housing 5 connected to plate 2 will form said cut successively to a deep drawn cup and to a hollow body with reduced wall thickness and correspondingly increased mantle length.

For forming a separate bottom profile, the hollow body is by the drawing mandrel 4 eventually pressed against a countertool which is arranged in a mounting 6 and which by means of a spring element 7 is axially yieldably connected to plate 8. This plate 8 is by means of two pull screws 19 and pressure sleeves 10 connected to the plate 2.

The finish shaped hollow body 11 is outside the housing 5 by means of a stripper ring 12 likewise arranged in housing 5 stripped off by the drawing mandrel 4 during the return movement of the latter and eventually drops downwardly and out due to its force of gravity.

With the described manufacturing process, disorders may be encountered, for instance when the strip has not been cut properly, when the material of the cutting tears during the drawing operation, or when in case the hollow body is also seamed in the drawing tool as to its length, the waste strip remains in the tool. Under these circumstances it will then only under relatively considerable effort be possible to eliminate the cause of the disturbance in the tool within the housing 5.

With the device according to the present invention it is therefore provided that the plate 2 will with the entire tool (the drawing mandrel 4 excepted) be arranged for pivoting about the axis X–Y, said axis extending transverse and at a distance *a* with regard to the axis of movement D–E of the drawing mandrel 4.

Plate 2 is firmly connected to a shaft 13 having an axis X–Y and through the intervention of said shaft is journalled in two brackets 15 which are connected to the frame 14 of the device. The pivoting movement of plate 2 and of the tool arrangement connected thereto is effected by means of a hydraulic cylinder piston system 16 mounted on frame 14. This cylinder piston system 16 by means of its connecting rod 17 eccentrically engages the shaft 13 at a point which is eccentrically located with regard to the axis X–Y and spaced therefrom by the distance *e*.

In normal operation, plate 2 is blocked relative to the frame 14 by two hydraulic cylinder piston systems 18. More specifically, the connecting rods 19 by means of hammer shaft end pieces 20 extending through recesses 21 on the rim of plate 2 press in moved-in position (upper portion of the drawing) against abutments 22 firmly connected to the frame 14 so that the plate 2 will be fixed in a defined position. The locking is so arranged that it cannot be unlocked as long as the drawing mandrel 4 is located within the region of plate 2. If also the drawing mandrel 4 is driven hydraulically, the pressure for the hydraulic fluid for cylinder piston system 18 may be generated by the same pump 35 which conveys the fluid for the drive. If then the locking system is disengaged due to the fact that the fluid pressure drops, the drive will automatically stop.

Figure 2:
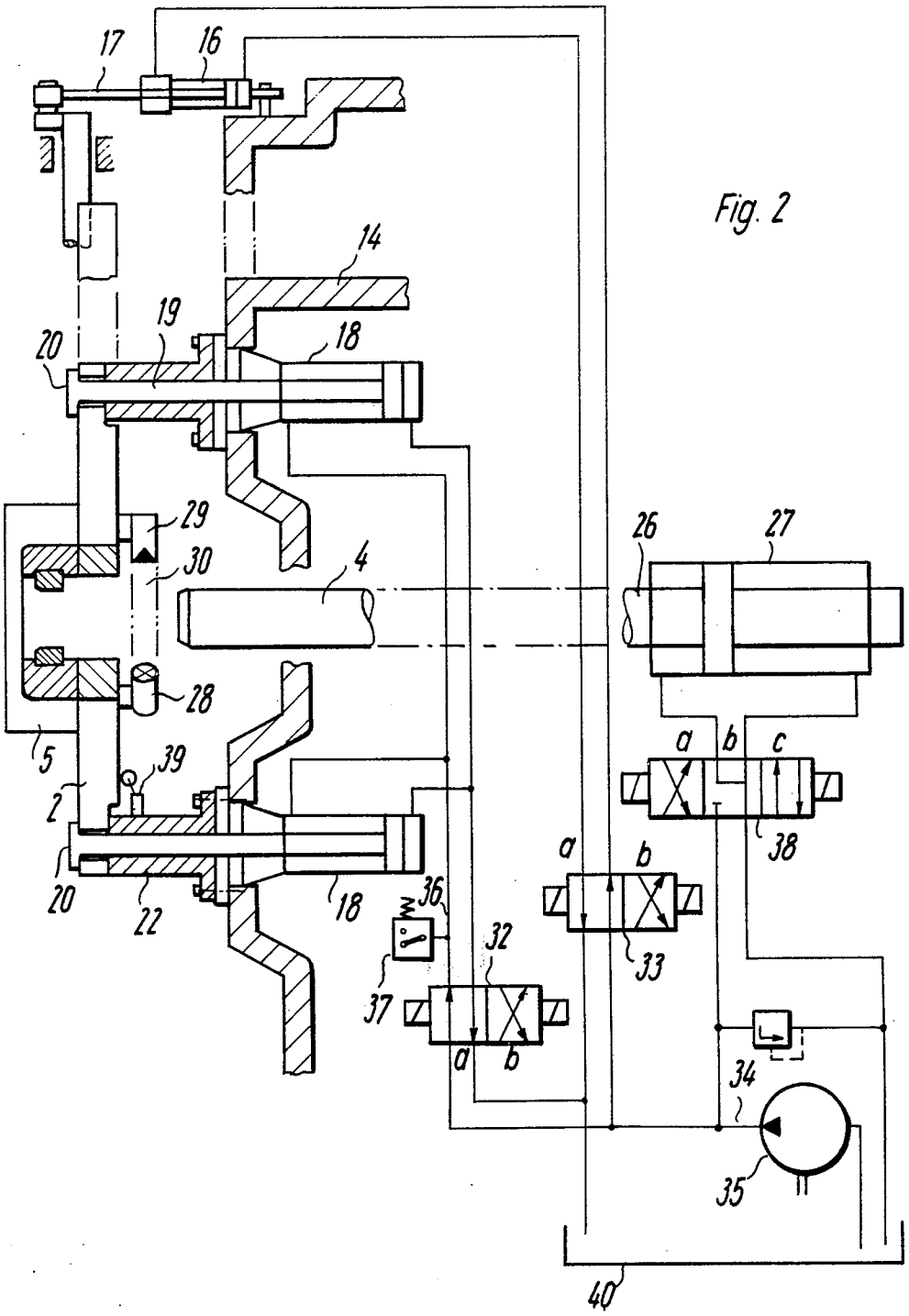
FIG. 2 shows the principle layout of the hydraulic locking device.

Design and operation of the locking device are shown in FIG. 2 of the drawing. As shown the drawing mandrel 4 is joined with the piston rod 26 of a further hydraulic cylinder 27 which, like the two hydraulic cylinders 18 and the hydraulic cylinder 16, is supplied with a fluid pumped out of a fluid tank through the pressure conduit 34 by a pump 35. By associated solenoid valves 32, 33 and 38 the fluid operating the hydraulic cylinders 18, 16, 27, respectively can be reversed or, in case of the hydraulic cylinder 27, the fluid can also be blocked by the solenoid valve 38 in its shown mid-position *b*.

Adjacent plate 2 a light beam barrier 28, 29 is arranged in such a way that a beam of light 30 emitted from the lamp 28 to the photo-electric cell 29 crosses the path of the drawing mandrel 4, i.e., the beam of light 30 is interrupted as soon and as long as the drawing mandrel 4 is within the region of the plate 2. The interruption of the beam of light 30 causes the solenoid valve 32 to be moved into or kept in the shown position *a*, at which via the conduit 36 the hydraulic cylinders 18 are supplied with pressure so that the piston rods 19 of the hydraulic cylinders 18 (and because of their hammer shaped end pieces 20 also the plate 2) are locked in the shown limit position. As in case of a drop in pressure this locking would become ineffective a pressure switch 37 is connected to the conduit 36 which in the said case of drop in pressure causes the solenoid valve 38 associated with the hydraulic cylinder 27 to be switched in the shown mid-position *b* at which the drive for the drawing mandrel 4 is cut out.

Finally there is a limit switch 39 connected to one of the abutments 22 which in non-operating position, i.e., when the plate 2 is swung out, also causes the solenoid valve 38 associated with the hydraulic cylinder 27 to be switched in the shown mid-position *b* at which the drive for the drawing mandrel 4 is prevented from being started.

With the illustrated locking mechanism, the stroke of the connecting rods 19 must be so long that when plate 2 is pivoted outwardly, outer edge 23 can on its path of movement 24 about the pivot axis X–Y pass by the inner edges 25 of the hammer shaped end pieces 20 of connecting rods 19 (see lower portion of the drawing with moved-out connecting rod 19).

As will be evident from the above, in case of need, all annular tools will be easily accessible in a simple manner. Due to the fact that the structural unit to which the tool elements have been combined can be pivoted off from the frame as an entirety. The thus obtainable advantages consist in a considerable reduction of idling times in case of disorders having to be eliminated with which for instance due to a fault in the material waste material is to be removed from the tool or a tool which became dull has to be exchanged. In this way, the production failures and the labor costs for necessary operations will be held to a minimum.

It is, of course, to be understood that the present invention is, by no means, limited to the specific showing in the drawing but also comprises any modifications within the scope of the appended claims.

What we claim is:

1. A device for making hollow bodies open at one end, especially by punching and deep drawing, which includes in combination: frame means provided with extension means, plate means for receiving and supporting annular tools for manufacutring the desired hollow body, connecting means connected to said plate means and pivotally journalled in said extension means, and actuating means operatively connected to said connecting means for pivoting said plate means with the annular tools thereon selectively from a first position in which the tools occupy their position of use to a second position for exchanging and repairing any one of the tools, and vice versa, said actuating means including a fluid operable cylinder-piston system for pivoting thereof and locking means for automatically locking said plate means in said first position, said locking means including pressure fluid operable cylinder-piston means for actuation thereof.

2. A device in combination according to claim 1, which includes driving means for driving the tools on said plate means, and means operatively connected to said locking means and permitting disengagement of said locking means only when said driving means is necessarily in turned off position.

* * * * *